United States Patent [19]

Ziegler

[11] Patent Number: 4,765,394

[45] Date of Patent: Aug. 23, 1988

[54] HEAT EXCHANGER WITH A SOOT BLOWER

[75] Inventor: Georg Ziegler, Winterthur, Switzerland

[73] Assignee: Sulzer Brothers Limited, Winterthur, Switzerland

[21] Appl. No.: 898,694

[22] Filed: Aug. 21, 1986

[30] Foreign Application Priority Data

Sep. 3, 1985 [CH] Switzerland ..... 3779/85

[51] Int. Cl.[4] ..... F22B 37/52; F28G 1/16

[52] U.S. Cl. ..... 165/95; 122/390; 122/392

[58] Field of Search ..... 165/95; 122/392, 390, 122/405

[56] References Cited

U.S. PATENT DOCUMENTS

| | | | |
|---|---|---|---|
| 1,517,440 | 12/1924 | Linaker | 122/392 |
| 1,664,865 | 4/1928 | Snow | 122/392 |
| 1,840,544 | 1/1932 | Thomas | 122/392 |
| 1,939,387 | 12/1933 | Coghlan | 122/392 |
| 4,602,677 | 7/1986 | Forster et al. | 122/392 X |
| 4,617,988 | 10/1986 | Köhnen et al. | 165/95 |

FOREIGN PATENT DOCUMENTS

| | | | |
|---|---|---|---|
| 444435 | 5/1925 | Fed. Rep. of Germany | 122/392 |
| 208485 | 12/1923 | United Kingdom | 122/392 |
| 1179067 | 1/1970 | United Kingdom | 122/392 |

*Primary Examiner*—Ira S. Lazarus
*Assistant Examiner*—Peggy Neils
*Attorney, Agent, or Firm*—Kenyon & Kenyon

[57] ABSTRACT

Each heat-exchanger surface is comprised of parallel coolant-carrying tubes and at least one soot-blowing tube which can be supplied with a soot-blowing medium and which has at least one nozzle for the egress of the soot-blowing medium. A protective tube connected to the heat-exchanger surface is disposed before and parallel to the soot-blowing tube on the heat-receiving side of the wall and is flowed through by the same coolant as flows through the heat-exchanger surface. The nozzle extend between the protective tube and the wall. The soot-blowing tube has satisfactory heating protection and the coolant in the protective tube has the same exit temperature as the other tubes of the heat-exchanger heating surface.

15 Claims, 2 Drawing Sheets

HEAT EXCHANGER WITH A SOOT BLOWER

This invention relates to a heat exchanger having a soot blower.

Heretofore, it has been known to provide heat exchange surfaces, for example of heat exchangers, with soot blowers, for example as described in Swiss Pat. No. 648,397 for the cleaning of the heat exchange surfaces from time-to-time. Generally, the heat exchangers are comprised of parallel coolant-carrying tubes which are welded together to form a wall with at least one soot-blowing tube which can be supplied with a soot-blowing medium and which has at least one nozzle for the egress of the soot-blowing medium. In the case of the soot blower described in Swiss Pat. No. 648,397, a tube of the heat exchanger surface extends coaxially around the soot-blowing tube at a distance therefrom so that coolant flows in the gap resulting between the two tubes and protects the soot-blowing tube against excessive temperatures. While this construction is inherently satisfactory, unfortunately, the temperature at which the coolant issues from the double tube arrangement is affected by the temperature of the soot-blowing medium and therefore differs from the temperature at which the coolant issues from the other tubes of the heat exchanger surfaces. In some circumstances, it may prove relatively complex to even out the temperature.

Accordingly, it is an object of the invention to provide a soot-blowing arrangement for a heat exchanger which has little effect on the temperature at which coolant leaves the heat exchanger surface.

It is another object of the invention to provide an improved soot blower.

It is another object of the invention to provide for satisfactory protection of a soot-blowing tube against high temperatures without affecting the temperature at which the coolant leaves the heat exchanger surface.

Briefly, the invention is directed to a heat exchanger which includes a plurality of coolant-conveying parallel tubes which are secured together to form a wall. In accordance with the invention, at least one soot-blowing tube extends along the wall between a pair of the coolant-conveying tubes while a coolant-conveying protective tube extends along the wall between the pair of coolant-conveying tubes parallel and in front of the soot-blowing tube on a heat receiving side of the wall. In addition, at least one nozzle extends from the soot-blowing tube to between the protective tube and the wall for blowing a soot-blowing medium therefrom. In this construction, the same coolant flows through the coolant-conveying tubes of the heat exchanger as well as through the protective tube.

Since the protective tube in front of the soot-blowing tube experiences virtually the same thermodynamic conditions as the other coolant-conveying tubes of the the heat exchanger wall, the temperature at which the coolant issues from the protective tube is substantially the same as the temperature at which the coolant issues from the other coolant conveying tubes.

The arrangement of the soot-blowing tube and protective tube is such that the soot-blowing tube is readily accessible during assembly and for any repairs. Further, it is a simple matter to change the nozzles or alter the number of nozzles extending from a soot-blowing tube in other to suit requirements.

These and other objects and advantages of the invention will become more apparent from the following detailed description taken in conjunction with the accompanying drawings wherein.

Figure 1:
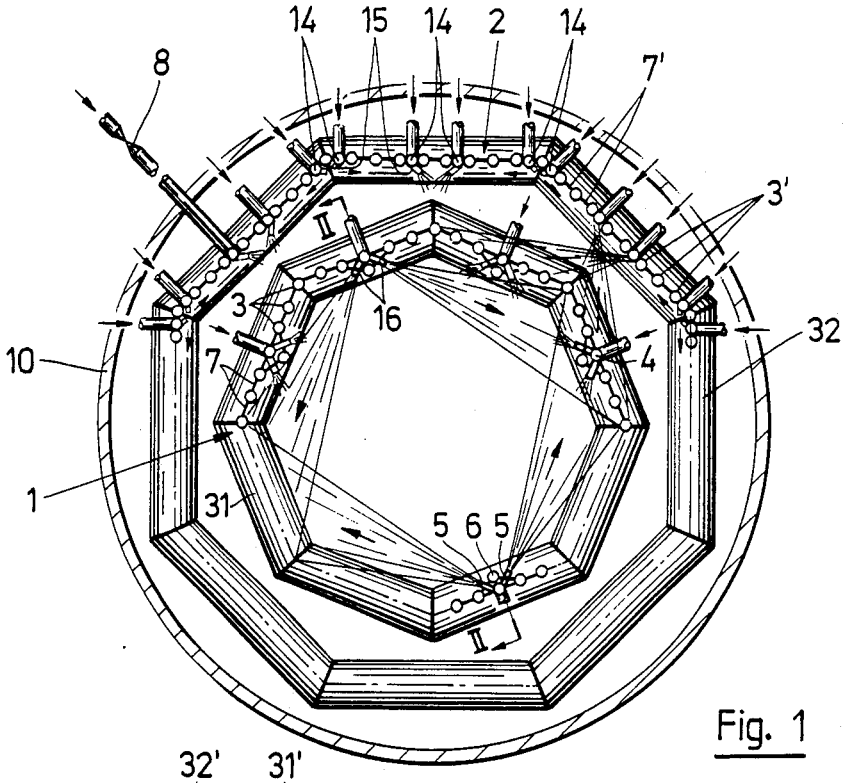
FIG. 1 illustrates a cross-sectional view through a synthesis gas cooler employing a soot-blower constructed in accordance with the invention.
Figure 2:
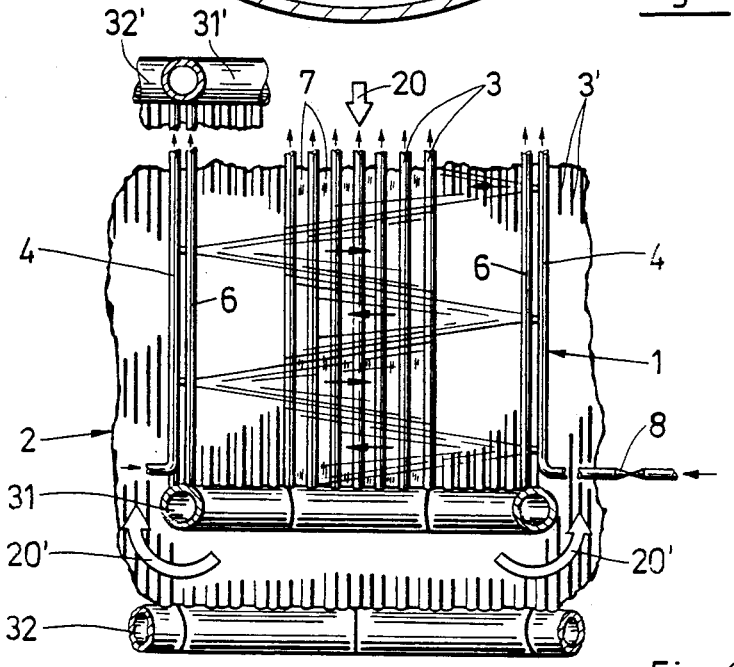
FIG. 2 illustrates a view taken on line II—II of FIG. 1.

Referring to FIGS. 1 and 2, the heat exchanger includes a pair of heat-exchanger surfaces 1, 2 which are disposed within a pressure vessel 10. The innermost heat-exchanger surface 1 is formed of a plurality of coolant-conveying parallel tubes 3 which are secured together to form a wall which defines a polygonal-shaped flow passage. As indicated, the tubes 3 are in the form of straight vertical water-carrying tubes 3 and are welded together in gas-tight manner by way of webs 7. As indicated in FIG. 1, the wall has sides which define a regular octagonal prism. The second heat-exchanger surface 2 is also in the form of a regular octagonal prism which is comprised of a plurality of vertical welded-together tubes 3' which are connected via webs 7'. This heat-exchanger surface 2 extends around the inner surface 1 coaxially and at an angular offset of 22.5 degrees.

The tubes 3 terminate at the lower end, as viewed in FIG. 2, in a horizontal octagonal distributor 31 while terminating at the upper ends in a header 31' which is identical to and parallel to the disbributor 31. In this way, the distributor 31 serves to deliver coolant to the tubes 3 in common.

Correspondingly, the tubes 3' of the outer heat-exchanger surface 2 terminate at the lower end in a distributer 32 and at the top in a header 32'. The distributor 32 and the header 32' are also octagonal and identical to one another while being disposed in parallel.

The headers 31', 32' are disposed at the same height as one another; however, the outer distributor 32 is placed lower than the inner distributor 31.

The heat exchanger surfaces 1, 2 are welded in seal tight manner to the associated distributors 31, 32 and to the associated headers 31', 32'. The distributors 31, 32 are connected to at least one water supply (not shown) while the headers 31', 32' are connected to at least one steam load (not shown). Where the heat exchanger is constructed, for example, as a synthesis gas cooler, hot synthesis gas flows downwardly through the polygonal-shaped flow passage defined by the inner heat exchanger surface 1 as indicated by the arrow 20, then flows around the distributor 31 as indicated by the arrows 20' (see FIG. 2) and then rises between the two surfaces 1, 2. During this time, the synthesis gas yields heat to the water in the tubes 3, 3' with steam being produced. During operation, substantially the same pressure is operative within the pressure vessel 10 housing the heat exchanger surfaces 1, 2 and the distributors 31, 32 and headers 31', 32'.

Referring to FIG. 1, each side of the octagonal prism of the inner heat exchanger surface 1 is provided at the center with a soot blowing tube 4 which is adapted to be supplied from at least one pressure gas source (not shown) with a soot-blowing medium. As shown in FIGS. 1 and 2, each soot-blowing tube 4 extends along the wall between a pair of coolant-conveying tubes 3 and has a plurality of nozzles 5 which are distributed along the tube 4. A suitable valve means such as a control valve 8 is disposed in a supply line to the soot-blowing tubes 4 in order to control the quantity of soot-blowing medium delivered to the soot-blowing tubes 4.

As shown in FIGS. 1 and 2, a protective tube 6 also extends along each side of the wall between a pair of tubes 3 and in front of a soot-blowing tube 4 on the heat receiving side of the wall. As indicated in FIG. 2, each protective tube 6 extends at the bottom into the distributor 31 and at the top into the header 31'. Thus, the same coolant, i.e. water, flows through the protective tubes 6 as through the tubes 3 in parallel relation.

The protective tubes 6 are of the same diameter as the wall tubes 3 and are made of the same material as the wall tubes 3. Each protective tube 6 serves to protect the associated soot blowing tube 4 from excessive temperatures and experiences thermodynamic conditions similar to those experienced by the wall tubes 3. Hence, the steam content of the water and steam mixture issuing from the protective tubes 6 is substantially the same as that of the mixture issuing from the wall tubes 3.

Figure 7:
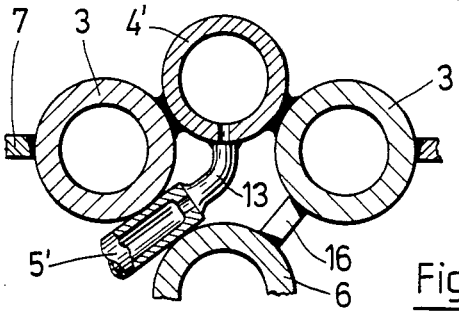
FIG. 7 illustrates a cross-sectional view of a modified nozzle arrangement in accordance with the invention.

Referring to FIG. 7, each protective tube 6 is connected to the adjacent wall tube 3 by metal members 16. In addition, each nozzle 5 extending from a soot-blowing tube 4 extends by way of a gap between two adjacent members 16 to between the protective tube 6 and the wall defined by the wall tubes 3. The nozzles of any blowing tube 4 are directed alternately towards the next-but-one side of the inner heat exchanger 1 (see FIG. 1) so that the soot-blowing medium engages the inside surface of each side of the inner heat exchanger 1 from two sides (FIG. 2).

As indicated in FIG. 1, all of the tubes are excessible from at least one wall side. This is of advantage for assembly and for repairs.

The outer heat exchanger surface 2 is provided with four soot-blowing tubes 14 which are disposed in each side of the octagonal prism 2 and take the place of a web 7'. As indicated in FIG. 1, two of the tubes 14 are disposed in the central zone of a side. The nozzles 15 of the tube 14 which is disposed left of center are directed toward the outside of the inner heat exchanger 1 which is right of center. Correspondingly, the nozzles 15 of the tube 14 which is disposed right of center are directed towards the outside of the inner heat exchanger 1 which extends left of center. The remaining two tubes 14 of each side of the octagonal prism of the outer heat exchanger surface 2 are disposed near the edges. The nozzles 15 of these tubes 14 are directed towards that side of the outer heat exchanger surface 2 which is adjacent the associated edge. Consequently, a pressurized soot-blowing medium engages from two directions with the outside surface of each side of the inner heat exchanger surface 1 and the inner surface of each side of the outer heat exchanger surface 2.

Since the synthesis gas which rises between the two surfaces 1, 2 has already been cooled to such an extent during the descent in the inner surface 1, the soot-blowing tubes 14 of the outer surface 2 do not need protection against excessive temperatures and do not require protective tubes.

The operation of the soot-blowing tubes shown in FIGS. 1 and 2 depends upon the extent and distribution of the soiling of the heat exchanger surfaces 1, 2 by the synthesis gas. When the control valve or valves 8 open, pressurized gas is blown through the soot-blowing tubes 14 and nozzles 5, 15 onto the surfaces of both heat exchanger surfaces 1, 2 and cleans the surfaces. These valves can be controlled manually or automatically. Generally, it is usually sufficient for the pressurized gas to be blown onto the surfaces alternately for brief periods. Only a small quantity of pressurized gas need be supplied to the blowing tubes 4, 14 in the period between the blowing periods in order to provide some cooling and to obviate any blocking of the nozzles 5, 15.

Generally, it is difficult in practice to determine in advance the distribution of the soiling on the heat exchanger surfaces 1, 2 since such distribution depends upon various parameters, such as the temperature distribution and flow pattern of the synthesis gas. However, because of the accessibility provided by the above describe structure, the distribution, direction and nature of the nozzles 5, 15 can be simply and inexpensively altered with a view to satisfying subsequently discovered cleaning requirements after the soot blower has been taken into operation. Indeed, the nozzles 5, 15 can be fitted after the extent and distribution of soiling has been observed in situ.

Figure 3:
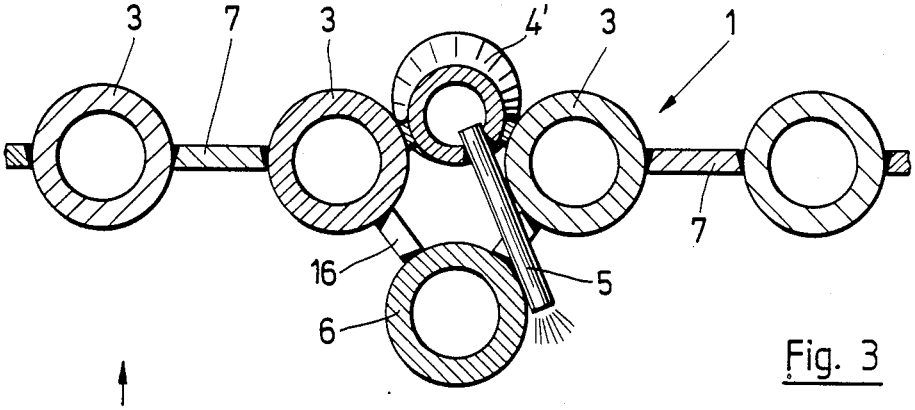
FIG. 3 illustrates a partial cross-sectional view of a heat exchanger surface employing a modified soot-blowing tube in accordance with the invention.
Figure 5:
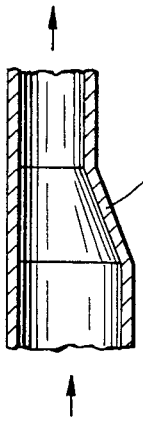
FIG. 5 illustrates a partial longitudinal sectional view through a soot blowing tube constructed in accordance with the invention.
Figure 4:
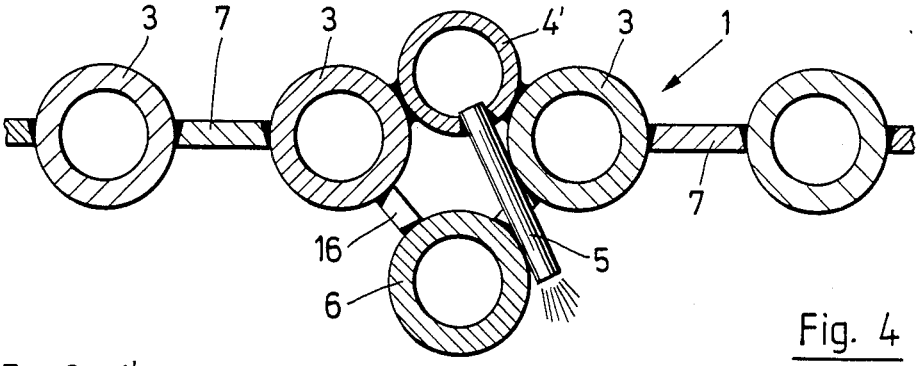
FIG. 4 illustrates a view similar to FIG. 3 but lower down on a heat exchanger surface.

Referring to FIGS. 3, 4 and 5, each soot-blowing tubes 4' is of decreasing cross-sectional area in the direction of flow of the soot-blowing medium. For example, as illustrated, each soot-blowing tube 4' has a diameter which decreases in step-wise manner such that cylindrical portions alternate with skew conical portions in order to define a straight surface facing the protective tube 6. That is, the generated surface of the tube 4' which extends smoothly downwardly arises on that side of the tube 4' which is near the protective tube 6. In this case, the soot blowing tube 4' is welded in seal tight relation to the two adjacent wall tubes 3.

The soot blowing tube can be decreased in cross-section, for example, since there is a decrease in the quantity of pressurized gas in the tube 4' caused by each nozzle 5 and, therefore, a particular pressure drop ensues. These pressure drops accumulate relatively rapidly as the number of nozzles 5 increases. By decreasing the cross section of the tube 4' the pressure loss is compensated. The grading of the tube 4' is optimized to ensure that the costs and the pressure pattern remain reasonable.

Further, when the synthesis gas cools, the condensation and solidification temperatures of the soiling products present in the gas are passed with a consequent appreciable increase in the soiling of the heat-exchanger surfaces 1, 2. Therefore, more nozzles 5 are conveniently provided in the bottom zone of the inner heat exchanger surface 1 than in the top zone thereof so that the pressure gas consumption increases downwardly.

The effect of the generated surface of the soot-blowing tube being plain or smooth on one side so that identical nozzles 5 can be used over the whole length of the tube 4'. Another possibility is for the blowing tube diameter to decrease continuously so that the complete tube is in the form of a skew cone.

Figure 6:
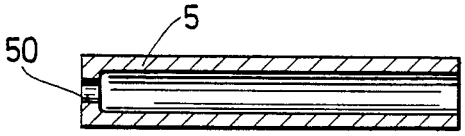
FIG. 6 illustrates a cross-sectional view through a nozzle of a soot-blowing tube.

Referring to FIG. 6, the nozzle 5 may be of a cylindrical shape with an end wall through which an exit bore 50 is provided. Such a nozzle has the advantage that, in assembly, a large number of such nozzles can be secured without drilling the bore 50 to the soot-blowing tubes with only the necessary nozzles 5 being made ready for operation, simply by being formed with the bore 50. After operating the soot-blower, additional nozzles 5 can be drilled so as to adapt to the actual cleaning requirements.

Referring to FIG. 7, wherein like reference characters indicate like parts as above, the soot blower can be provided with a nozzle 5' having a relatively large diameter. In this case, the nozzle 5' forms, with the plane in which the webs 7 extend, a more acute angle than the nozzle 5 of FIGS. 3 and 4. Further, as indicated, the nozzle 5' is connected to the soot-blowing tube 4' by way of a tube bend 13.

For the sake of simplicity, only a single control valve 8 is shown in each of FIGS. 1 and 2 although one such valve is provided for each soot-blowing tube 4, 14. However, it may be more convenient to have simultaneous control by a single valve of the quantity of pressure gas for all the soot-blowing tubes 4 and all the soot-blowing tubes 14. For increased reliability of operation, the number of control valves can be provided in a redundant series and/or parallel arrangement. Another possibility is to use quite simple shut off valves instead of the control valves if soiling is very heavy so that the greatest possible quantity of soot-blowing medium is blown continuously onto the heat exchanger surfaces in normal operation.

Depending upon the particular use, the nozzles 5, 15 can be directed towards wall sides other than those shown in FIGS. 1 and 2. In contrast to FIG. 2, a number of nozzles can, if require, act from different directions on the same zone of one side of the wall.

The soot-blowing tubes and the protective tubes can be made of any suitable cross-section, for example, circular or elliptical.

The invention thus provides a heat exchanger which can be provided with a soot blower which is of economical construction and which is economical in use.

Further, the invention provides a soot blower in which the soot blowing tubes can be satisfactorily protected with little, if any, effect on the tempeature at which a coolant leaves a heat exchanger surface.

What is claimed is:

1. In a heat exchanger, the combination comprising a plurality of coolant-conveying parallel tubes secured together in gas-tight manner to form a wall;

at least one soot-blowing tube extending along said wall and being secured to and between a pair of said coolant-conveying tubes in gas tight manner;

a coolant-conveying protective tube secured to and extending along said wall parallel and in front of said soot-blowing tube on a heat receiving side of said wall, said protective tube being connected in parallel with said coolant-conveying tubes relative to a flow of coolant therethrough; and at least one nozzle extending from said sootblowing tube and said heat receiving side of said wall between said protective tube and one of said coolant-conveying tubes for blowing a soot-blowing medium therefrom.

2. The combination as set forth in claim 1 wherein said wall defines a polygonal-shaped flow passage, each side of said wall having a soot-blowing tube at the center thereof with each nozzle extending from a respective soot-blowing tube being directed toward a next-but-one side.

3. The combination as set forth in claim 1 which further comprises a distributor connected to said protective tube and said coolant-conveying tubes in common to deliver a coolant thereto and a header connected to said tubes in common to receive the coolant therefrom.

4. The combination as set forth in claim 1 wherein said soot-blowing tube is of decreasing cross-sectional area in the direction of flow of the soot-blowing medium.

5. The combination as set forth in claim 4 wherein said soot-blowing tube has a diameter which decreases in step-wise manner to define a straight surface facing said protective tube.

6. The combination as set forth in claim 1 which further comprises valve means for controlling the quantity of soot-blowing medium delivered to said soot-blowing tube.

7. The combination as set forth in claim 1 wherein said wall includes a plurality of sides defining a polygonalshaped flow passage, each side of said wall having a sootblowing tube therein.

8. The combination as set forth in claim 7 wherein said flow passage is of regular prismatic shape.

9. The combination as set forth in claim 7 which further comprises a distributor connected to each protective tube in common to deliver a coolant thereto.

10. The combination as set forth in claim 7 wherein each soot-blowing tube is of decreasing cross-sectional area in the direction of flow of the soot-blowing medium.

11. In a heat exchanger, the combination comprising a plurality of coolant-conveying parallel tubes secured together to form a gas tight wall;

at least one soot-blowing tube extending along one side of said wall between a pair of said coolant-conveying tubes for conveying a soot-blowing medium;

a coolant-conveying protective tube extending along an opposite heat receiving side of said wall from said soot blowing tube and connected between said pair of coolant-conveying tubes parallel and in front of said soot-blowing tube;

a distributor connected to said coolant conveying tubes and said protective tube for delivering coolant thereto; and at least one nozzle extending from said soot-blowing tube and said wall between said protective tube and one of said coolant-conveying tubes for blowing a soot-blowing medium therefrom.

12. The combination as set forth in claim 11 wherein said wall defines a polygonal-shape flow passage, each side of said wall having a soot-blowing tube at the center thereof with each nozzle extending from a respective soot-blowing tube being directed toward a next-but-one side.

13. The combination as set forth in claim 11 wherein said soot-blowing tube is of decreasing cross-sectional area in the direction of flow of the soot-blowing medium.

14. The combination as set forth in claim 13 wherein said soot-blowing tube has a diameter which decreases in stepwise manner to define a straight surface facing said protective tube.

15. The combination as set forth in claim 11 wherein said wall includes a plurality of sides defining a polygonal-shaped flow passage, each side of said wall having a soot-blowing tube therein.

* * * * *

UNITED STATES PATENT AND TRADEMARK OFFICE

CERTIFICATE OF CORRECTION

PATENT NO. : 4,765,394

DATED : August23, 1988

INVENTOR(S) : GEORG ZIEGLER

It is certified that error appears in the above-identified patent and that said Letters Patent is hereby corrected as shown below:

Title page:

In the Abstract, line 10 "extend" should be -extends-
Column 1, line 66 "other" should be -order-
Column 3, line 42 "excessible" should be -accessible-
Column 4, line 61 "so" should be -is-
Column 5, line 33 "require" should be -required- Signed and Sealed this Twenty-first Day of February, 1989

*Attest:*

DONALD J. QUIGG

*Attesting Officer*

*Commissioner of Patents and Trademarks*